US006572456B2

(12) United States Patent
Weber-Grabau et al.

(10) Patent No.: US 6,572,456 B2
(45) Date of Patent: Jun. 3, 2003

(54) BATHLESS WAFER MEASUREMENT APPARATUS AND METHOD

(75) Inventors: Michael Weber-Grabau, Sunnyvale, CA (US); Ivelin A. Anguelov, Sunnyvale, CA (US); Edric H. Tong, Sunnyvale, CA (US); Adam E. Norton, Palo Alto, CA (US); Fred E. Stanke, Cupertino, CA (US); Badru D. Hyatt, San Jose, CA (US)

(73) Assignee: Sensys Instruments Corporation, Santa Clara, CA (US)

( * ) Notice: Subject to any disclaimer, the term of this patent is extended or adjusted under 35 U.S.C. 154(b) by 27 days.

(21) Appl. No.: 09/927,142

(22) Filed: Aug. 10, 2001

(65) Prior Publication Data

US 2002/0065028 A1 May 30, 2002

Related U.S. Application Data

(60) Provisional application No. 60/224,578, filed on Aug. 11, 2000.

(51) Int. Cl.[7] ..... B24B 7/00; B24B 9/00

(52) U.S. Cl. ..... 451/65; 451/60; 451/8

(58) Field of Search ..... 451/65, 8, 6, 60, 451/36, 5, 388

(56) References Cited

U.S. PATENT DOCUMENTS 5,647,952 A 7/1997 Chen
5,957,749 A 9/1999 Finarov
6,000,996 A * 12/1999 Fujiwara ..... 451/6
6,045,433 A 4/2000 Dvir et al.
6,117,780 A * 9/2000 Tsai et al. ..... 438/692
6,179,956 B1 * 1/2001 Nagahara et al. ..... 156/345.14
6,254,459 B1 * 7/2001 Bajaj et al. ..... 451/41
6,291,350 B1 * 9/2001 Hashimoto et al. ..... 438/692

* cited by examiner

*Primary Examiner*—Dung Van Nguyen
(74) *Attorney, Agent, or Firm*—Stallman & Pollock LLP

(57) ABSTRACT

A wafer measurement apparatus (10, 110) and method for measuring a film thickness property of a wafer (30) that does not require a water bath or complicated wafer handling apparatus. The apparatus includes a chuck (16) having an upper surface (20) for supporting the wafer, and a perimeter (18). Also included is a metrology module (50) for measuring one or more film thickness properties. The metrology module is arranged adjacent the chuck upper surface and has a measurement window (60) with a lower surface (64) arranged substantially parallel to the chuck upper surface, thereby defining an open volume (68). The apparatus includes a water supply system in fluid communication with the open volume via nozzles (70) for flowing water through and back-filling the volume in a manner that does not produce bubbles within the volume. A catchment (40) surrounding the chuck may be used to catch water flowing out of the volume. Methods of performing measurements of one or more wafer film properties are also described.

17 Claims, 6 Drawing Sheets

BATHLESS WAFER MEASUREMENT APPARATUS AND METHOD

CROSS-REFERENCE TO RELATED APPLICATION

This application claims priority under 35 U.S.C. 119(e) from prior U.S. provisional application no. 60/224,578, filed Aug. 11, 2000.

TECHNICAL FIELD

The present invention relates to wafer measurement apparatus and methods, and in particular relates to apparatus and methods for measuring the properties of one or more films on a wafer without the need for a wafer bath or complex wafer handling apparatus.

BACKGROUND ART

Chemical-mechanical polishing (CMP) is a well-known process in the semiconductor industry used to remove and planarize layers of material ("films") deposited on a semiconductor device to achieve a planar topography on the surface of the semiconductor device. To remove and planarize the layers of the deposited material, including dielectric and metal materials, CMP typically involves wetting a pad with a chemical slurry containing abrasive components and mechanically "buffing" the front surface of the semiconductor device against the wetted pad to remove the layers of deposited materials on the front surface of the semiconductor device and planarize the surface.

Once polished, the wafer is cleaned at a cleaning station to remove any chemicals and slurry particulates that remain from the polishing process. Once cleaned, the wafers are brought to a measurement station to determine if the polisher produced the desired thickness and planarity of the top layers on the wafer. This typically involves performing an optical measurement that extracts the film thickness from measured reflectivity using thin-film analytical techniques. Often, it is preferred to make such measurements with the wafer upper surface immersed in water. For example, it is necessary to keep the wafer surface wet to prevent solid slurry residue from forming if the wafer is measured right after polishing but before cleaning.

An apparatus for measuring the film thickness of a wafer to determine if polishing is complete is described in U.S. Pat. No. 5,957,749 (the '749 patent) and U.S. Pat. No. 6,045,433 (the '433 patent). The '749 and '433 patents disclose an optical measurement station for measuring the film thickness of the one or more films on the wafer. The measurement station comprises a water bath ("liquid holding unit") for receiving a wafer held by a gripping system. The liquid holding unit has a bottom surface, a portion of which is a window through which at least a portion of the top layer of the wafer is viewable. The gripping system grips the wafer and places it in the bath top surface down and at an angle relative to the horizontal. This tilting is necessary to allow any bubbles that might be trapped by the wafer top surface to escape, and so that the top surface can be viewed through the window. Once in the water bath, the wafer then needs to be tilted back to horizontal to perform the thickness measurement. An optical thickness measurement unit is in operative communication with the liquid holding unit and is used to measure the thickness of the top surface of the wafer through the window.

Unfortunately, the apparatus of the '749 and '433 patents has seven major disadvantages. The first is the need for a water bath for holding water in which the wafer can be placed during measurement. For large wafers, the bath must be quite large and hold a significant amount of water. In addition, this water needs to be clean and thus replaced frequently. The second disadvantage is that the wafer must be tilted when it is placed in the bath, and then made level once in the batch, which complicates the wafer measurement procedure and reduces throughput. A third disadvantage is that the gripper arm design is fairly complex because of the need to tilt the wafer when placing it in the water bath, and re-tilting the wafer to horizontal once in the bath. The fourth disadvantage is that the throughput of wafers is less than desirable because of the system complexity and the need to tilt the wafers with the specially designed wafer handler ("gripper arm"). These disadvantages add cost and complexity to the system, as well as reduce the effectiveness of the apparatus in a manufacturing environment. The fifth disadvantage is that slurry particles and other contaminants in the water tend to sink to the bottom of the bath and settle on the surface of the window. Contamination on the window adversely affects the measurement, in particular if thin films of <1000 A are measured. The sixth disadvantage is that parts of the top surface of the wafer are obscured by a support against which the wafer is held while upside down in the tank. A seventh disadvantage is that a wafer can accidentally be dropped (for example, when the gripper vacuum fails) and fall to the bottom of the tank, resulting in the need to stop the polisher to initiate a recovery procedure, or manually remove the wafer.

Accordingly, it would be advantageous to have an apparatus and associated methods of measuring the film thickness wafer without the above-described disadvantages.

SUMMARY OF THE INVENTION

The present invention relates to wafer measurement apparatus and methods, and in particular relates to apparatus and methods for measuring the film properties of one or more films on a wafer without the need for a wafer bath or complicated wafer handling apparatus.

Accordingly, a first aspect of the invention is wafer measurement apparatus for measuring a film thickness property of a wafer having an upper surface. The apparatus comprises a chuck having an upper surface for supporting the wafer, and a perimeter. A metrology module for measuring one or more wafer thickness properties, is arranged adjacent the chuck upper surface. The metrology module has a window with a lower surface arranged substantially parallel to the chuck upper surface. This arrangement defines an open volume between the chuck upper surface and the window lower surface. The apparatus further includes a water supply system in fluid communication with the open volume for flowing water through the open volume.

A second aspect of the invention is a wafer polishing system comprising the above-described wafer measurement apparatus and a wafer polishing system, such as a CMP tool, in operable communication with the wafer measurement apparatus.

A third aspect of the invention is a method of measuring a film thickness property of a wafer having an upper surface. The method comprises the steps of arranging the wafer in an open volume formed by a measurement window on one side and chuck upper surface on the opposite side. The wafer is placed on the chuck upper surface with the wafer upper surface facing the measurement window. The next step is flowing water through the open volume so as to fill the open volume. This is done in a manner that results in now bubbles being formed within the volume as water back-fills the volume, e.g., by flowing the water slowly at first so that the flow is established. The final step then involves measuring the film thickness property of the wafer through the measurement window.

BEST MODE FOR CARRYING OUT THE INVENTION

The present invention relates to wafer measurement apparatus and methods, and in particular relates to apparatus and methods for measuring film properties of one or more films on a wafer without the need for a wafer bath or complex wafer handling apparatus. Such film properties include, for example, thickness, dishing, erosion, reflectivity, scratched, residue, etc.—in other words, those film properties that can be deduced by optical measurement.

Figure 1:
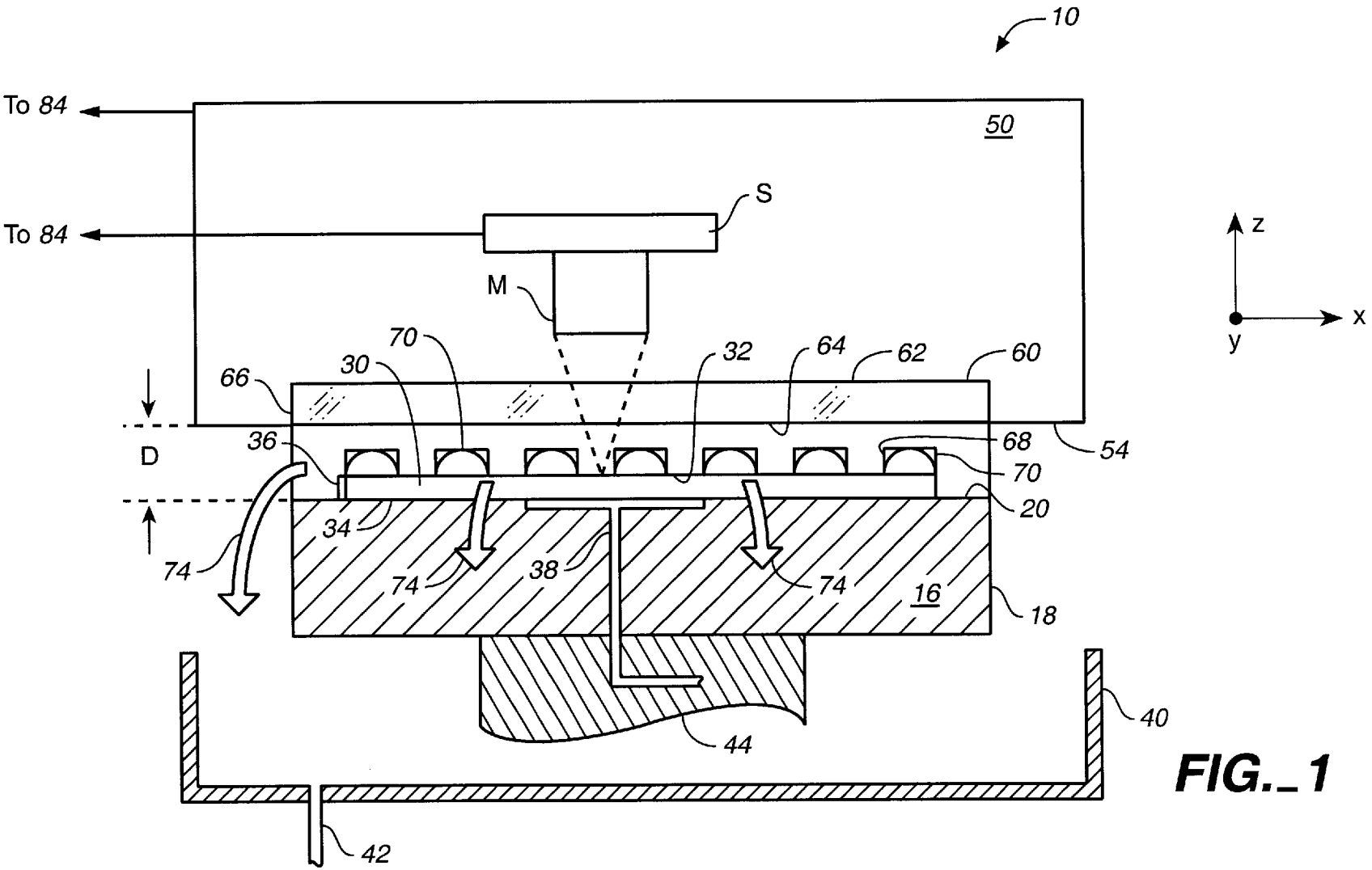
FIG. 1 is a schematic cross-sectional view of the measurement apparatus of the present invention illustrating the flow of water over the wafer while a measurement of the wafer is being made.
Figure 2:
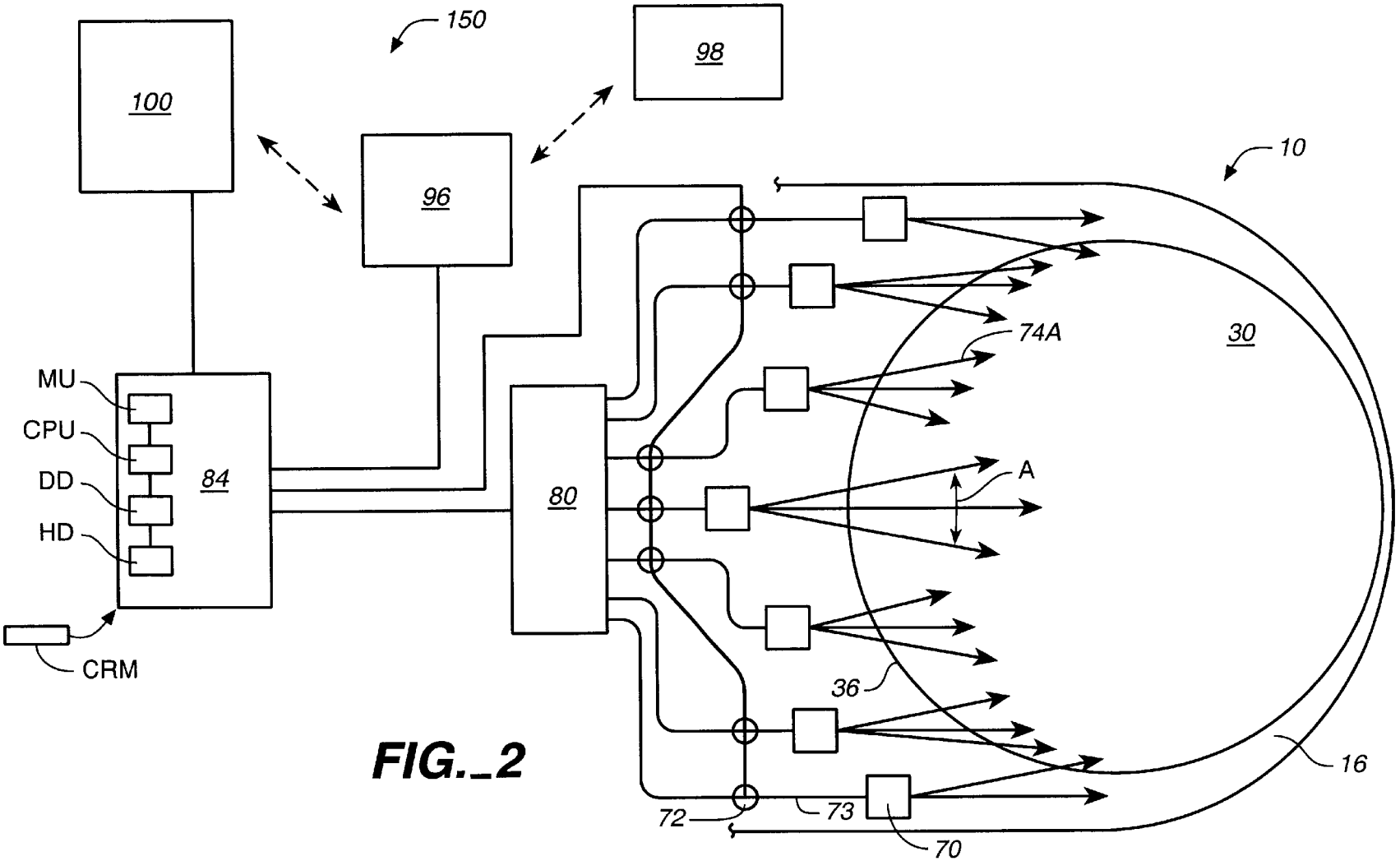
FIG. 2 is a schematic diagram of a wafer polishing system that includes the measurement apparatus of FIG. 1 (shown in a plan view with the metrology module removed), illustrating the flow of water from the nozzles over the wafer when operating the measurement apparatus.

With reference to FIGS. 1 and 2, there is shown a wafer measurement apparatus 10 comprising a wafer support member (hereinafter, "chuck") 16 with a perimeter 18 and an upper surface 20 upon which a wafer 30 having an upper surface 32, a lower surface 34 and a perimeter 36. Wafer 30 is supported with the upper surface facing away from chuck 16. Chuck 16 in the present invention is used as shorthand and is meant to include various types of known wafer support members, such as three-pin supports or edge supports. The specific chuck 16 shown in the Figures is representative of such wafer support members and is used for the sake of illustration. Chuck 16 is preferably adjustable in the z-direction to facilitate placement of wafer 30 and for other reasons discussed below.

Wafer 30 is typically coated with one or more layers of material, referred to herein as "films" (not shown) that are to have one or more of their properties measured. Here, the one or more films are collectively referred to in the singular as a film with a thickness for the sake of simplicity. The film thickness property, for example, may be determined by measuring film thickness properties such as refractive index, reflectivity or other properties from which thickness can be inferred. Such measurements of film properties are often made after a wafer has undergone chemical-mechanical polishing (CMP). Also, the wafer surface may have structures such metallic contacts embedded into dielectric films, as in the copper damascene process. For these structures, important wafer properties such as dishing and erosion must be measured to accomplish process control.

With continuing reference to FIG. 1, chuck 16 preferably includes a vacuum line 38 connected at one end to a vacuum system (not shown) and in pneumatic communication with chuck upper surface 20 at the opposite end so that wafer 30 is vacuum-fixed to the chuck upper surface. Arranged adjacent perimeter 18, preferably below the level of chuck upper surface 20, is a catchment 40 with a drain 42 for collecting water flowing off upper surface 20 of chuck 16 and over the perimeter, as described below. Catchment 40 may be in the form of a pan or tank designed to collect water that would otherwise flow onto the floor (not shown) supporting apparatus 10. In an embodiment where chuck 16 is adjustable in the z-direction, apparatus 10 includes an elevator member 44 in operable communication with chuck 16, for moving the chuck in the z-direction. The z-direction is the direction normal to chuck upper surface 20 (or wafer upper surface 32) and is considered the "vertical" direction in the present invention. Elevator member 44 may be, for example, a hydraulic or pneumatic lift. Elevator member 44 is preferably under control of a control system, such as control system 84 described below.

Apparatus 10 further includes a metrology module 50 having a lower surface 54 arranged adjacent wafer upper surface 20, for measuring one or more properties of the wafer upper surface. Metrology module 50 may include, for example, an optical reflectometer such as described in U.S. patent applications Ser. Nos. 60/125,462 and 60/128,915, filed on Mar. 22, 1999 and Apr. 12, 1999, respectively, which Patent Applications are incorporated by reference herein. Metrology module 50 may also be an ellipsometer or other thin-film measuring instrument known in the art. Metrology module 50 includes a measurement window 60 having an upper surface 62, a lower surface 64 and a perimeter 66. Window 60 is arranged adjacent wafer 30 with lower surface 64 substantially parallel to wafer upper surface 32 and chuck upper surface 20, with lower surface 64 facing wafer upper surface 32. Surfaces 32 and 64 are separated by a distance d, which may typically range from about –0.1 mm to 50 mm. Measurement window lower surface 64 and chuck upper surface 20 form opposite ends of an open volume 68 into which wafer 30 can be inserted. Adjustment of chuck 16 in the z-direction can be used to control the size of volume 68.

In the case of a circularly shaped window, volume 68 is in the form of a cylinder with imaginary sides that depend from measurement window perimeter 66 down to chuck upper surface 20. Window 60 may have essentially the same area (i.e., be of substantially the same size as) wafer 30 or only be a portion of the size. In the latter case, lower surface 54 of metrology module 50 is made flush with window lower surface 64 (see FIG.

Metrology module 50 includes a measuring head M arranged adjacent measurement window 60 that emits and/or receives a signal (e.g., emitted and/or reflected light) through the measurement window from wafer upper surface 32 for the purpose of measuring one or more properties of wafer 30. In this sense, measurement head M is in operative communication with volume 68 and wafer upper surface 32. Measurement head M is preferably attached to an X-Y stage S so that the measurement head can be directed to obtain measurements of one or more properties at different sites on wafer 30.

With continuing reference to FIGS. 1 and 2, adjacent a portion of perimeters 36 and 66 (i.e., adjacent volume 68) is arranged one or more nozzles 70 each connected to a water supply system 80 via a corresponding one or more fluid lines 73 each preferably containing a valve 72, thereby providing adjustable fluid communication between the water supply system and volume 68. Valves 72 can also be arranged within system 80, but are shown incorporated in fluid lines 73 for the sake of illustration. Nozzles 70 are oriented such that water 74 supplied from water supply system 80 flows from the nozzles into volume 68. When a wafer 30 is placed in volume 68, the water flows onto and across upper surface 32 of wafer 30 and lower surface 64 of window 60, thereby filling the volume. The flow of water 74 from each nozzle preferably has a divergence angle A such that the entire upper surface 32 is flooded with water, as described below. In a preferred embodiment, each of nozzles 70 is adjustable to change the flow divergence angle A.

Apparatus 10 further includes a wafer handling system 96 and a wafer storage unit (e.g., a cassette) 98 that may be used to store, for example, wafers that have been polished and that are awaiting measurement. Wafer handing system 96 is in operative communication with wafer storage unit 98 and chuck 16, and is used to transfer wafers 30 between the wafer storage unit and chuck 16 for measurement.

Apparatus 10 also preferably includes a control system 84 electronically connected to wafer handling system 96, water supply system 80, and valves 72 for controlling the operation of apparatus 10, as described in greater detail below. In a preferred embodiment, control system 84 is a computer having a memory unit MU with both random-access memory (RAM) and read-only memory (ROM), a central processing unit CPU (e.g., a PENTIUM™ processor front Intel Corporation), and a hard disk HD, all electronically connected. Hard disk HD serves as a secondary computer-readable storage medium, and may be, for example, a hard disk drive for storing information corresponding to instructions for control system 80 to control the devices connected thereto. Control system 84 also preferably includes a disk drive DD, electronically connected to hard disk HD, memory unit MU and central processing unit CPU, wherein the disk drive is capable of accepting and reading (and even writing to) a computer-readable medium CRM, such as a floppy disk or compact disk (CD), on which is stored information corresponding to instructions for control system 84 to carry out the method steps of the present invention. An exemplary control system 84 is a computer, such as a DELL PRECISION WORKSTATION 610™, available from Dell Corporation, Dallas, Tex.

Figure 3:
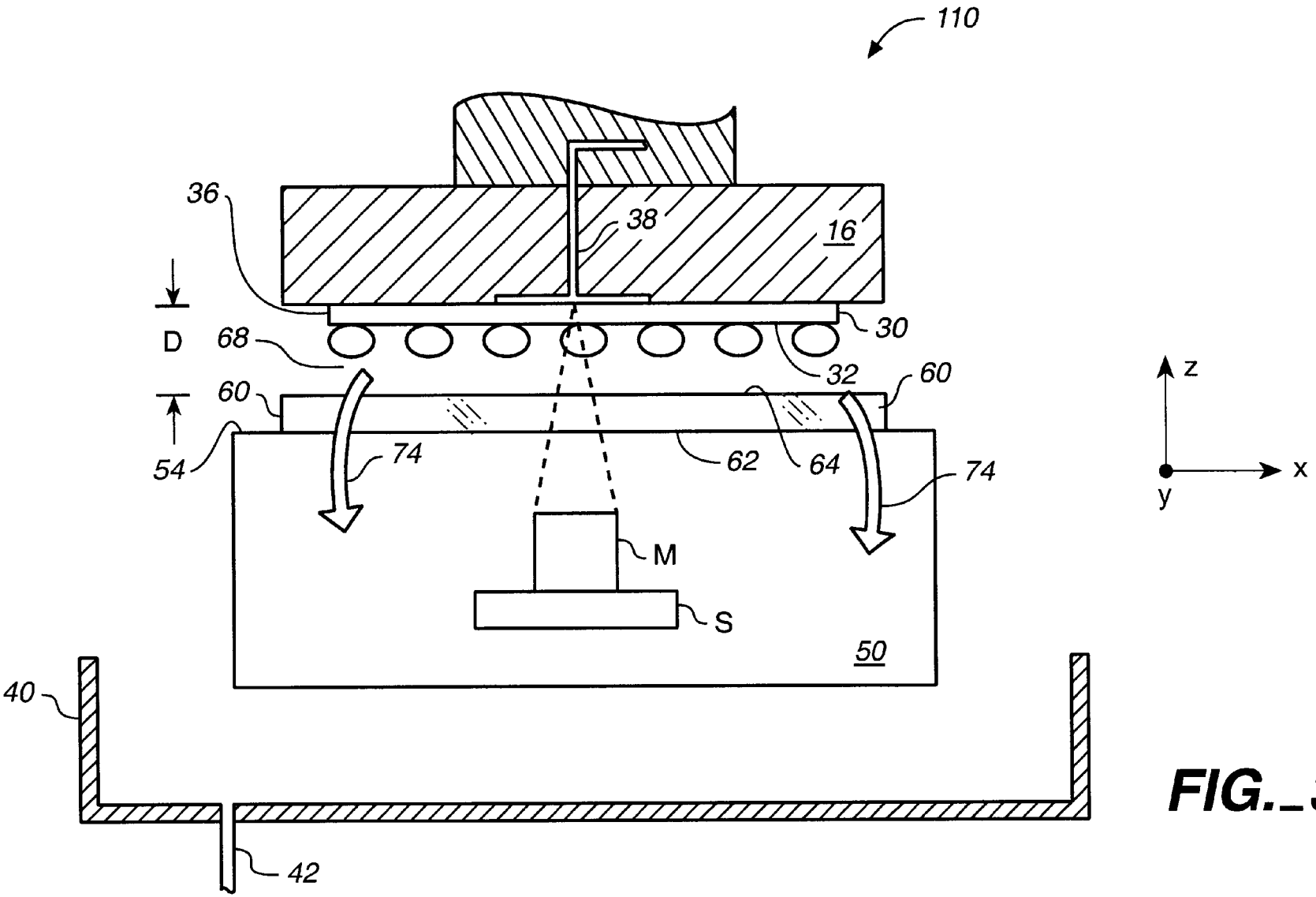
FIG. 3 is a schematic cross-sectional view of a second embodiment of the apparatus of the present invention similar to that of FIG. 1 in that the apparatus of the second embodiment is essentially an upside down version of the apparatus of FIG. 1.

With reference now to FIG. 3, there is shown a wafer measurement apparatus 110 as an alternate embodiment to apparatus 10 and having the same elements as apparatus 10. Apparatus 110 is essentially apparatus 10 arranged upside down so that metrology unit 50 is underneath chuck 16 in relation to the floor (not shown) that supports apparatus 110.

In this case, water 74 flows across wafer upper surface 32 (now arranged facing the negative z direction) and window lower surface 64 (now arranged facing the positive z direction). Catchment 40 is now arranged around metrology module 50 rather than chuck 16. Also, it may be preferred that measurement window 60 not be flush with metrology module lower surface 54.

Figure 4A:
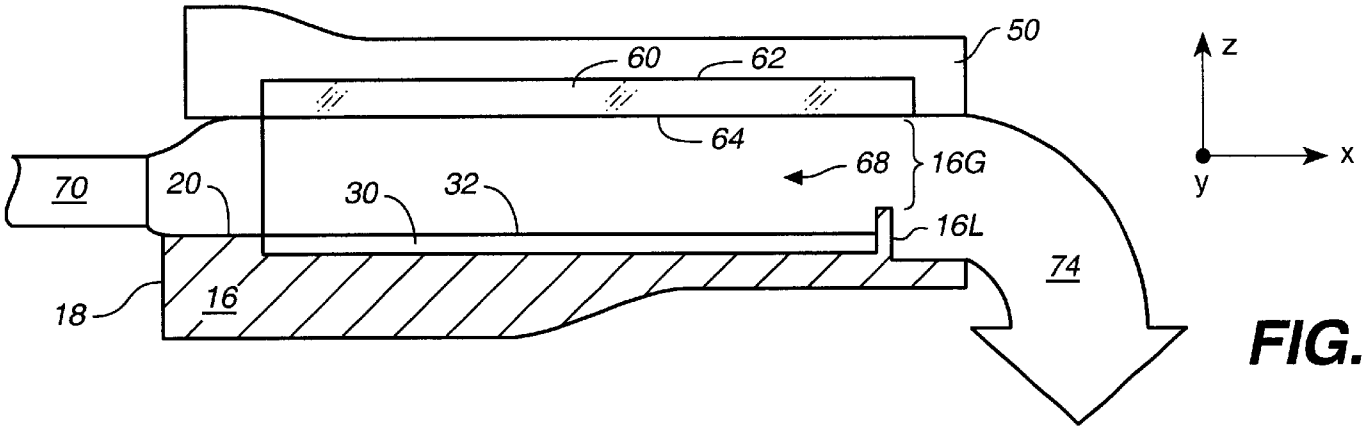
FIGS. 4A is a schematic cross-sectional view of a close-up of a portion of the apparatus of FIG. 1 illustrating the flow of water from nozzles through the open volume defined by the chuck and viewing window in the presence of a lip on the chuck located opposite the nozzles.
Figure 4B:
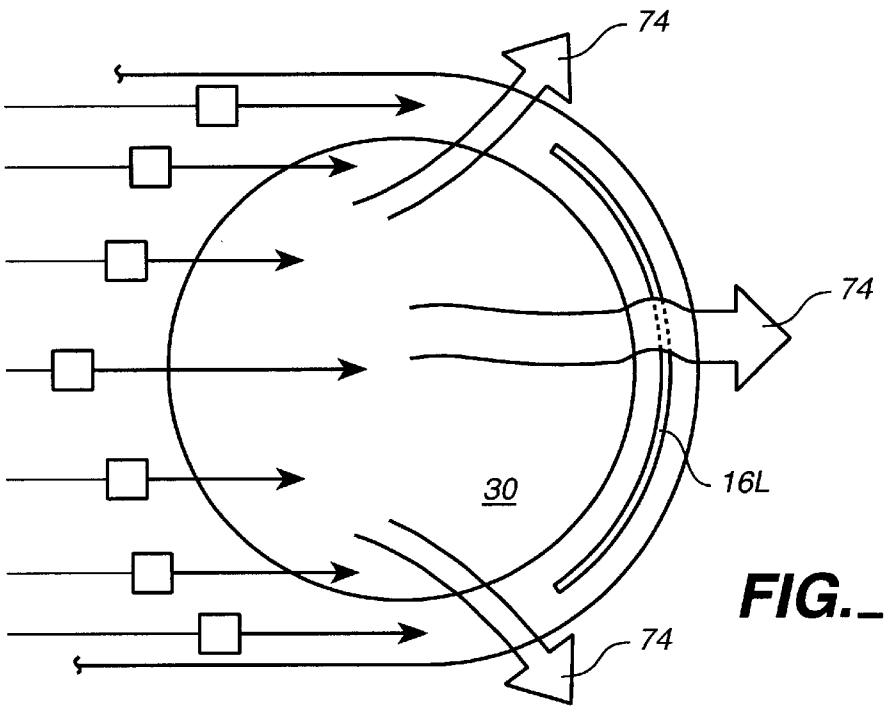
FIG. 4B is a plan view of a portion of the apparatus of FIG. 1 with the metrology module removed, providing a second illustration of the flow of water across the wafer and over the wafer's perimeter in the presence of a lip on the chuck located opposite the nozzles.

With reference now to FIGS. 4A and 4B, apparatus 10 or 110 may include as part of chuck 16 a lip 16L arranged at or near chuck perimeter 18 extending upward in the positive z direction. Lip 16L is designed to facilitate the build up of water 74 at wafer upper surface 32 as the water flows between wafer 30 and window 60. Lip 16L can extend almost all the way up to window 50 or metrology module 50, as long as there is a gap 16G through which air can escape when water 74 replaces the air in volume 68.

Figure 5:
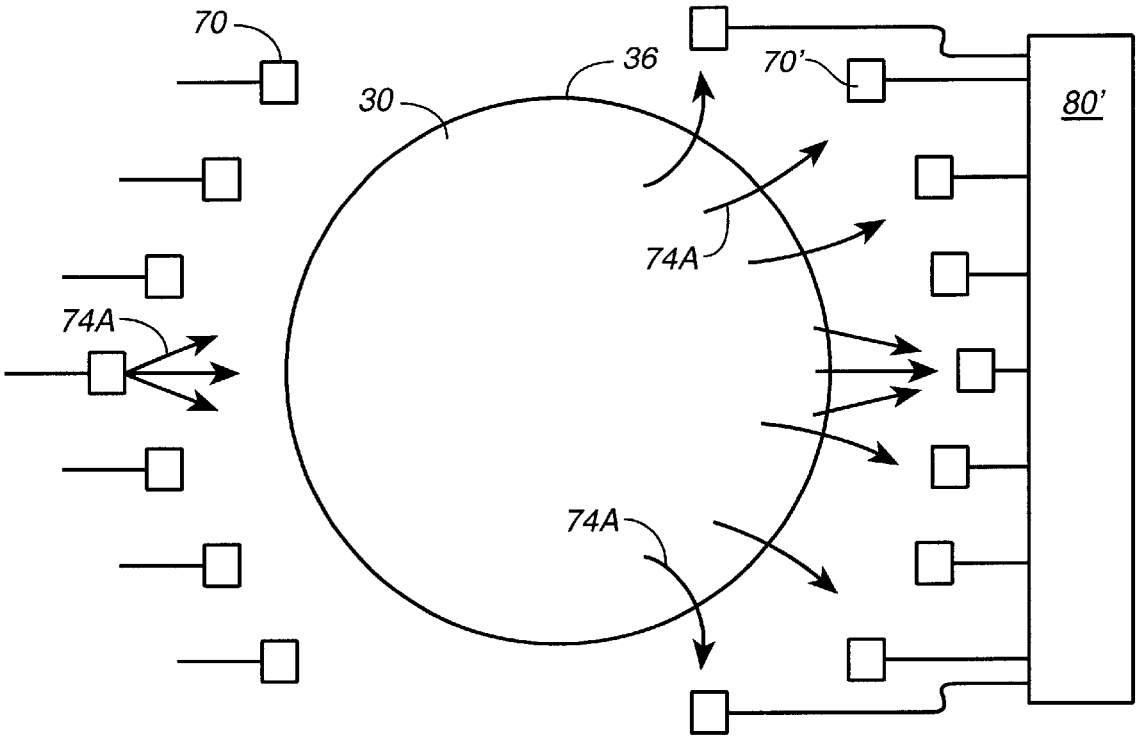
FIG. 5 is a plan view of a portion of the apparatus of FIG. 1 with the metrology module removed, providing a third illustration of the flow of water across the wafer and over the wafer's perimeter in the presence a second set of intake nozzles for removing water after it has flowed over the wafer perimeter.

With reference now to FIG. 5, apparatus 10 or 110 may include a second set of one or more (intake) nozzles 70' arranged along perimeters 36 and 66 (i.e., adjacent volume 68) opposite first set of one or more (output) nozzles 70. Nozzles 70' are in fluid communication with a water removal system 80'. Nozzles 70' are designed to intake water 74 that flows in volume 68 between wafer 30 and window 60 and transfer the water to water removal system 80'. Nozzles 70' can be used to reduce the amount of water falling into catchment 40, or to eliminate the need for catchment 40 altogether. Water removal system 80' preferably includes vacuum capability so that water 74 flowing from volume 68 is sucked into nozzles 74 and into the water removal system.

Figure 6:
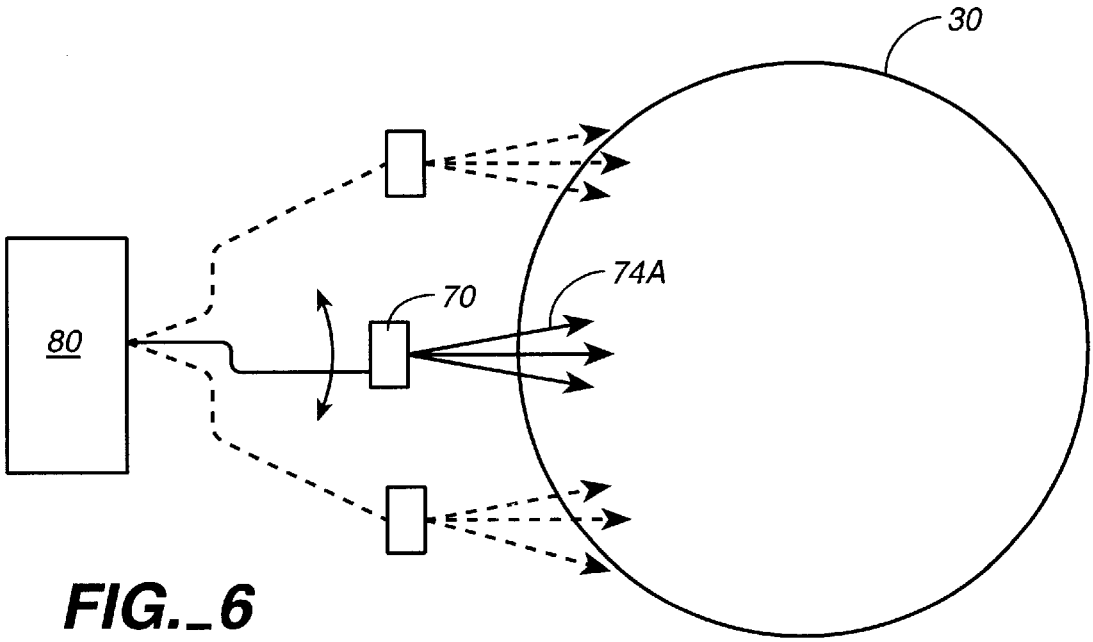
FIG. 6 is a plan view of a portion of the apparatus of FIG. 1 with the metrology module removed, providing a fourth illustration of the flow of water across the wafer and over the wafer's perimeter using a single movable nozzle.

With reference to FIG. 6, apparatus 10 may include a single movable nozzle 120 in fluid communication with water supply system 80. Nozzle 120 is designed to rapidly sweep back and forth (as illustrated by the double-ended arrow) so that water 74 flows across the entire upper surface 32 of wafer 30.

With reference again to FIG. 1, wafer handling system 96 may also be in operative communication with a wafer polishing apparatus 100, such as a CMP tool, so that a wafer 30 that has just been polished can be placed on chuck 16 to have its film thickness measured. The combination of wafer polishing apparatus 100 and apparatus 10 or apparatus 110 constitutes a wafer polishing system 150 that can be used to polish and measure wafers. An exemplary wafer polishing apparatus is described in U.S. Pat. No. 5,647,952, which patent is incorporated by reference herein. Wafer polishing apparatus 100 and apparatus 10 or 100 are in operative communication via wafer handling system 96 and/or by other means (e.g., electronically via control system 84).

Method of Operation

The operation of the present invention is now described with reference to apparatus 10. The method described below also applies to apparatus 110 as well.

With reference to FIG. 2, control system 84 directs wafer handler 96, via an electronic signal, to transfer a wafer from wafer storage unit 98 (or from wafer polishing apparatus 100) to upper surface 20 of chuck 16. Because of the presence of the metrology unit, wafer 30 is introduced to open volume 68 from the side, i.e., along the x-y plane. To facilitate the placement of wafer 30, the vertical position of chuck 16 may be adjusted by activating elevator member 44. Once in place, wafer 30 may be secured to chuck upper surface 20 via a vacuum provided line vacuum line 38 connected to a vacuum system (not shown). Once wafer 30 is secure on chuck upper surface 20 and chuck 16 is arranged in the desired vertical position, control system 84 opens valves 72 and also activates water supply system 80, which contains water 74 under pressure.

Figure 7:
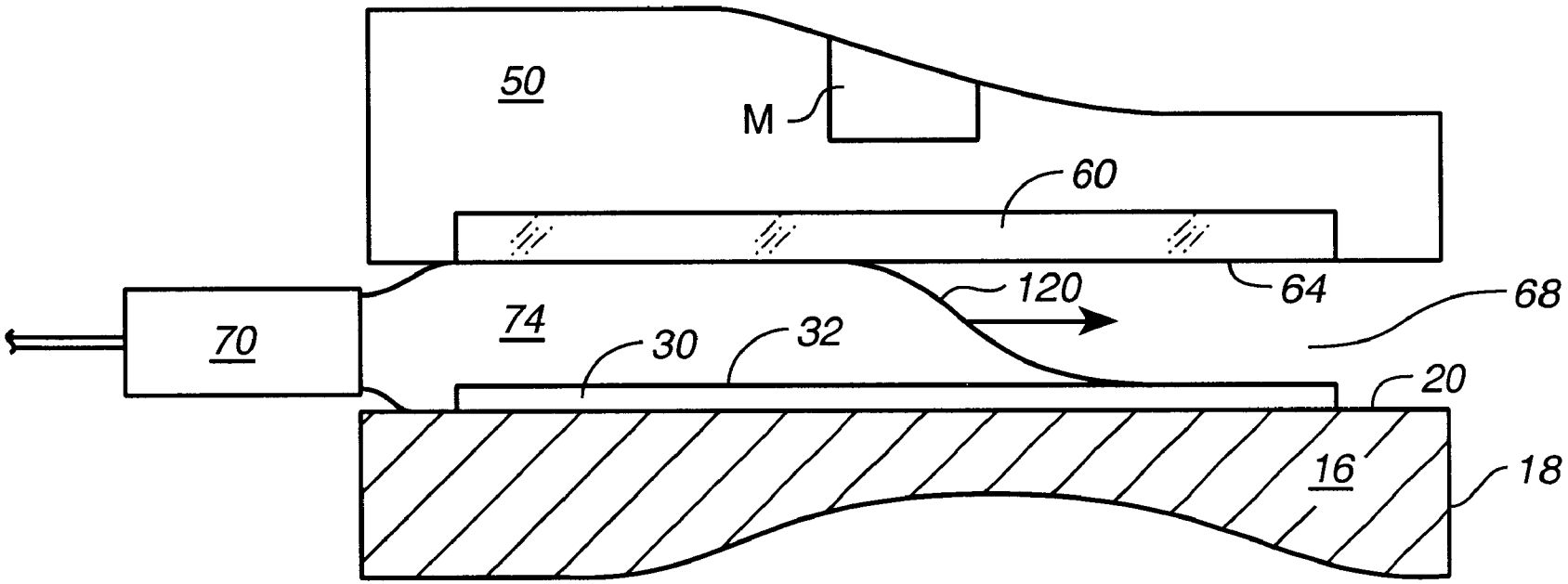
FIG. 7 is a schematic cross-sectional view of a close-up of a portion of the apparatus of FIG. 1 illustrating the flow of water from the nozzles through the open volume defined by the chuck and viewing window, in the form of a wave that propagates through the volume in a manner that results in water completely back-filling the volume with no bubbles being formed within the volume.

With reference now also to FIG. 7, water 74 is flowed into volume 68 such that the volume initially fills from top to bottom in the vicinity of nozzles 70 and sweeps through the volume and across wafer upper surface 32 in a wave 120 that does not form bubbles within the volume as water back-fills the volume. A preferred manner of flowing water 74 within volume 68 to avoid the creation of bubbles is to allow water 74 to flow from nozzles 70 at a slow rate at first, and then to increase the rate once the flow is initiated and wave 120 begins moving across wafer upper surface 32. The actual flow rate will vary depending on the spacing d between chuck upper surface 20 and window lower surface 64, and the time allowable to fill the volume with water, and is best determined empirically. A typical flow rate for a spacing d of 4 mm is approximately 200 ml/sec.

The flow from nozzles 70, as mentioned above, is preferably somewhat divergent, as indicated in FIG. 2 by angle A the arrows 74A depicting the flow of water from the nozzles. This is so that the entire upper surface 32 of wafer 30 is covered when the flow of water 74 is established. The more nozzles 70 used, the less divergent the flow of water 74 from the nozzles needs to be.

Once the flow of water 74 is established within volume 68 so that the volume is filled, control system 84 activates metrology module 50 via an electronic signal, which causes measuring head 70 to emit and/or to receive a signal (e.g., emitted and/or reflected light) from wafer upper surface 32 for the purpose of measuring one or more film thickness properties. This operation may be accomplished over a number of measurement sites by adjusting the position of measurement head M using X-Y stage S electronically via control system 84. While one or more measurements are being made, water supply system 80 continues to flow water in sufficient amounts to keep volume 68 filled. The water passing through open volume 68 exits the volume at perimeter 36 of wafer 30 and is either received by nozzles 70', or falls into catchment 40 and is drained away through drain 42 (FIG. 1).

Once one or more film thickness measurements are made using metrology system 50, control system 84 sends an electronic signal to close valves 72 to stop the flow of water 74 through nozzles 70. At this point, control system 84 sends an electronic signal to wafer handler 96 to remove wafer 30 and to transfer it to a second wafer storage unit (not shown) for storing measured wafers, or back to first storage unit 98. At this point, wafer handler 96 engages the next wafer 30 to be measured (which may be residing on wafer polishing apparatus 100) and transfers it to chuck 16 in the manner described above. The process described above is then repeated for this second wafer 30.

Apparatus 10 and 110 have several distinct advantages over the prior art. The first is that the present apparatus is "bathless", i.e., it does utilize a water bath in which the wafer to be measured would otherwise need to be immersed, such as in the prior art apparatus disclosed in the '749 and '433 patents. The second is that present invention of apparatus 10 and 110 allows each wafer to be flooded with fresh, clean water. Further, no special wafer handling apparatus is needed to insert the wafer into a water bath at an angle and then tilt the wafer again once it is in the bath. The third advantage is that in the present invention, wafer handling system 96 is a standard wafer handler, such as the Wetbot manufacturer by the Equipe subsidiary (Mountain View, Calif.) of PRI Corporation. This greatly simplifies the apparatus, and allows for greater throughput. The fourth advantage is that the apparatus of the present invention prevents slurry deposits from forming on window 60 due to the flow of water 74 over lower surface 64 of the window. A fifth advantage is that the wafer may be loaded device-side up, without any frontside contact and throughput degradation because of flipping it upside down. A sixth advantage is that less space is needed in the CMP tool below the plane in which the wafer is loaded, greatly simplifying integration.

The many features and advantages of the present invention are apparent from the detailed specification and thus, it is intended by the appended claims to cover all such features and advantages of the described method which follow in the true spirit and scope of the invention. Further, since numerous modifications and changes will readily occur to those of ordinary skill in the art, it is not desired to limit the invention to the exact construction and operation illustrated and described. Accordingly, all suitable modifications and equivalents should be considered as falling within the spirit and scope of the invention as claimed.

What is claimed is:

1. A wafer measurement apparatus for measuring a film thickness property of a wafer having an upper surface, comprising:

a) a chuck having an upper surface for supporting the wafer, and a perimeter;

b) a metrology module for measuring one or more film thickness properties, arranged adjacent the chuck upper surface and having a window with a lower surface arranged substantially parallel to the chuck upper surface, thereby defining an open volume between said chuck upper surface and said window lower surface;

c) a water supply system in fluid communication with said open volume for flowing water through said open volume; and d) one or more intake nozzles arranged to receive water flowing from said open volume.

2. An apparatus according to claim 1, wherein said window covers substantially the same area as the wafer.

3. An apparatus according to claim 1, further including a control system in electronic communication with said water supply system.

4. An apparatus according to claim 3, further including a wafer handling system in electronic communication with said control system and in operable communication with said chuck.

5. An apparatus according to claim 4, further including a wafer storage unit arranged such that said wafer handling system is in operable communication with said wafer storage unit.

6. A wafer polishing system comprising:

a) the wafer measurement apparatus according to claim 4; and b) a wafer polishing apparatus in operative communication with said wafer measurement apparatus via said wafer handling system.

7. An apparatus according to claim 1, further comprising an elevator member in operable communication with said chuck, for adjusting the vertical position of said chuck.

8. An apparatus according to claim 1, further including a catchment arranged about said chuck perimeter so as to collect water flowing over the chuck perimeter.

9. An apparatus according to claim 1, further including:

a) one or more nozzles fluidly connected to said water supply system and arranged around said chuck perimeter.

10. An apparatus according to claim 9, wherein said nozzles are designed to provide divergent flow of water into said open volume.

11. An apparatus according to claim 10, wherein said one or more nozzles are adjustable to change the divergence of the flow of water.

12. An apparatus according to claim 9, further including:

a) one or more corresponding fluid lines connecting said nozzles and to said water supply system; and b) one or more corresponding valves arranged in said corresponding fluid lines, for controlling the flow of water through said fluid lines.

13. An apparatus according to claim 10, further including a control system in electronic communication with said water supply system and said one or more valves.

14. An apparatus according to claim 1, further including a water removal system in fluid communication with said intake valves.

15. An apparatus according to claim 1, wherein said metrology module includes a measurement head in operable communication with said open volume, for measuring a wafer thickness property of the wafer through said window.

16. An apparatus according to claim 1, wherein said chuck includes a vacuum line in pneumatic communication with said chuck upper surface, for vacuum fixing the wafer to said chuck upper surface.

17. A wafer polishing system comprising:

a) the wafer measurement apparatus according to claim 1; and b) a wafer polishing apparatus in operative communication with said wafer measurement apparatus.

* * * * *